US006287632B1

(12) United States Patent
Nishio et al.

(10) Patent No.: US 6,287,632 B1
(45) Date of Patent: Sep. 11, 2001

(54) ROTOLINING PROCESS USING FLUORO POLYMER POWDER

(75) Inventors: Takao Nishio; Tsuneo Aida, both of Shimizu (JP)

(73) Assignee: DuPont Mitsui Flurochemical, Tokyo (JP)

( * ) Notice: Subject to any disclaimer, the term of this patent is extended or adjusted under 35 U.S.C. 154(b) by 0 days.

(21) Appl. No.: 09/504,921

(22) Filed: Feb. 16, 2000

(30) Foreign Application Priority Data

Feb. 24, 1999 (JP) ..... 11-046344

(51) Int. Cl.[7] ..... B05D 7/22

(52) U.S. Cl. ..... 427/183; 427/195; 427/231; 427/234; 427/240; 427/242

(58) Field of Search ..... 427/181, 183, 427/195, 230, 231, 234, 240, 242; 264/310, 311

(56) References Cited

U.S. PATENT DOCUMENTS 5,397,831 3/1995 Saito et al. ..... 524/502
5,473,018 * 12/1995 Namura et al. ..... 525/200

FOREIGN PATENT DOCUMENTS 0 515 030 * 11/1992 (EP) .
0 778 088 A2 6/1997 (EP) ..... B05D/7/22
0 778 088 * 11/1997 (EP) .

* cited by examiner

*Primary Examiner*—Fred J. Parker

(57) ABSTRACT

A process for rotolining a cylindrical article is provided, wherein the rotolining powder contains both fluoropolymer and filler and has a particle size of 70–1000 micrometers, and the cylindrical article (surface being lined) is rotated at a speed of at least 100 m/sec$^2$ while heating the powder to press the powder against the surface being lined to thereby form the lining.

9 Claims, No Drawings

ROTOLINING PROCESS USING FLUORO POLYMER POWDER

FIELD OF THE INVENTION

This invention is in the field of rotolining with melt processible fluoropolymers.

BACKGROUND OF THE INVENTION

Fluoropolymers such as tetrafluoroethylene/perfluoro (alkyl vinyl ether) (PFA) tetrafluoroethylene/hexafluoropropylene (FEP), tetrafluoroethylene/ethylene (ETFE), and the like, exhibit melt flow at a temperature at or above the melting point of the polymer. Such polymers are designated here as "melt processible" and are extensively used as excellent film forming materials that produce coatings with minimal pinholes or voids. Melt processible fluoropolymers are distinguished from polytetrafluoroethylene (PTFE), the homopolymer of tetrafluoroethylene that is processed by other means.

Fluoropolymer coatings are useful as linings for pipes and vessels, providing them with corrosion resistance, non-stickiness, abrasion resistance, and chemical resistance. In addition, being made of fluoropolymers, the linings are effective over a broad temperature range. Traditional means of applying coatings include powder coating, sheet lining, and rotational lining, also known as rotolining. In the case of powder coating, the maximum thickness that can be applied is about 100 $\mu$m. If thicker coatings are attempted, gas bubbles are often entrapped. These bubbles constitute defects in the coating, contributing to surface roughness and to actual or potential thin spots or pinholes. However, for best corrosion resistance, a lining thickness of 500 $\mu$m or greater is desirable. Therefore, it has been necessary to make multiple applications to build up to the desired thickness.

Sheet lining is an alternative method for applying a coating. In sheet lining, a 2 to 3 mm thick film of PFA or PTFE, backed with a glass fabric, is bonded to the substrate with an adhesive, and the joint where the ends of the film meet is sealed or welded. Sheet lining gives coatings of the necessary thickness, but useful temperature range of the coating is limited to that of the adhesive, which is generally less than the useful temperature range of the fluoropolymer.

In the rotolining molding process melt processible polymer in powder form is added to the article to be lined. Then the article is heated as it is rotated around at least two rotational axes. Rotation distributes the melting polymer uniformly over the interior surface of the hollow article resulting in a coating of uniform thickness. Cooling the article causes the polymer to solidify, fixing the lining to the surface of the article.

Rotolining has been applied principally to low melt viscosity resins such as polyethylene, polypropylene, or the like, but the process has begun to be applied to fluoropolymers in order to make use of their excellent properties. There is a tendency however, for substantial bubble formation as the film becomes thicker occurring at 340–380° C. See, for example, European Patent Application 0 778 088 A2, which reports gas bubble formation in the rotolining process as applied to fluoropolymers. This is overcome only by high rotation speeds, that is, high radial acceleration, and operation in a narrow temperature range just above the melting point of the fluoropolymer. Nothing is written about the thickness of the lining attained under these conditions.

A rotolining process is needed that permits the formation, with a single application of fluoropolymer powder, of a fluoropolymer lining at least 500 $\mu$m thick. This lining should be substantially free of defects such as bubbles or voids, and its surface should be smooth, to facilitate flow and prevent fouling by material caught on surface imperfections, such as depressions and asperities.

SUMMARY OF THE INVENTION

A rotolining process which comprises placing a powder having an average particle size of 70–1000 $\mu$m containing a melt processible fluoropolymer, in a cylindrical article to be lined, said powder being present in sufficient amount to make a lining at least 500 $\mu$m thick, rotating said cylindrical article to bring the radial acceleration at the substrate surface to be coated to 100 m/sec$^2$ or greater, pressing said powder against the article to be lined by means of the centrifugal force generated by that rotation, at the same time heating the melt processible fluoropolymer to a temperature equal to or higher than the melting point of the melt processible fluoropolymer, but not higher than 400° C., thereby adhering the melt processible fluoropolymer to the surface of the article to be lined.

A preferred embodiment of the invention is a rotolining process comprising forming a first layer of a melt processible fluoropolymer powder composition containing a filler on the substrate surface of the article to be lined, and then overlaying a second layer of filler-free melt processible fluoropolymer powder on the surface of said first layer.

DETAILED DESCRIPTION OF THE INVENTION

The melt processible fluoropolymers of this invention include the copolymers tetrafluoroethylene/perfluoro(alkyl vinyl ether) (PFA) tetrafluoroethylene/hexafluoropropylene (FEP), and tetrafluoroethylene/ethylene (ETFE). Among the melt processible fluoropolymers, PFA, is preferred because of its thermal stability and chemical resistance. The PFA preferably has a specific melt viscosity at 372° C. in the range of $5\cdot10^3$ to $1\cdot10^6$ poise (of $5\cdot10^2$ to $1\cdot10^5$ Pa·s). If the specific melt viscosity is lower than $5\cdot10^3$ poise ($5\cdot10^2$ Pa·s), the resin will have inferior thermal stability and resistance to stress cracking, making it an unsatisfactory lining material. If the specific viscosity exceeds $1\cdot10^6$ poise ($1\cdot10^5$ Pa·s) removal of gas bubbles will be retarded, particularly when the fluoropolymer is used with a filler.

The average particle size of the powder used in this invention is 70–1000 $\mu$m, preferably 100–500 $\mu$m. A powder with an average particle size less than 70 $\mu$m will usually cause the powder particles to agglomerate before film formation begins. This results in large secondary particles, which will produce film with a rough surface. A powder with an average particle size greater than 1000 $\mu$m will reduce film forming capability, resulting in a poor surface smoothness.

The rotational rate used in rotolining according to this invention need only be enough to force the fluoropolymer powder against surface to be coated and to prevent its moving while the fluoropolymer is melting and the film is being formed. As shown in the Examples, for lining a tube 81 mm in inner diameter, 500 rpm is adequate. This corresponds to a circumferential speed of about 2 m/sec, or, to state this in terms independent of the diameter of the article to be coated, a radial acceleration of about 100 m/sec$^2$. A radial acceleration of 200 m/sec$^2$ is preferable. As regards the coating, there is no upper limit to the radial acceleration, although mechanical stress on the equipment used and economic considerations impose practical limitations.

It is sometimes desirable to incorporate a filler in the fluoropolymer powder used in this invention so that the coating will have a thermal shrinkage as close to that of the substrate as possible. This will to prevent differential shrinkage when the article is cooled after coating. Therefore, if a filler is compounded with the fluoropolymer for the object of reducing shrinkage, it is preferred to use a heat resistant filler that has at least lower thermal shrinkage than that of the fluoropolymer. A glass fiber filler is particularly effective for reducing the shrinkage.

Adding a small amount of a heat stabilizer such as PPS (polyphenylene sulfide) to prevent the decomposition of the fluoropolymer on heating can give an excellent coating with minimal bubble formation. These additives may include combinations; for example, as proposed in Japanese Patent 2550254, the use of a melt processible fluoropolymer powder composition is preferred in which a small amount of heat stabilizer PPS is added and uniformly incorporated within the melt processible fluoropolymer particles, along with the heat resistant filler.

Despite the benefits of addition of heat resistant filler to the fluoropolymer, for corrosive service, or where maintenance or high purity of the materials contacting the liner, filler-free fluoropolymer should be used. The benefits the filler and of a filler-free surface on the liner can be achieved by applying firstly a fluoropolymer powder that contains a filler, heating and rotating to form the coating, cooling, and then applying secondly a filler-free fluoropolymer powder, heating and rotating to form a filler-free coating overlaying the filler-containing coating.

For optimum surface smoothness, it is beneficial if the temperature of the process does not exceed 343° C. and that the radial acceleration be at least 100 m/sec$^2$.

Another approach to excellent surface smoothness on the coating is through use of a blend of polytetrafluoroethylene having a heat of crystallization of at least 305° C. and heat of crystallization of at least 50 J/g with the melt processible fluoropolymer powder. The use of such polytetrafluoroethylene in extrusion is known, as disclosed for example in U.S. Pat. No. 5,473,018. However it is a surprising aspect of this invention that with such a blend, the rotolining temperature can be selected from any temperature equal to or higher than the melting point of the polymer, up to 400° C. The amount of the above polytetrafluoroethylene to be compounded with the melt processible fluoropolymer should be less than 4% by weight with respect to the total weight of the fluoropolymer, but should be enough to cause the generated film to have a recrystallized average spherulite diameter of not more than 15 $\mu$m in preferred embodiments.

It is further preferred for improved adhesion with the substrate to treat the substrate with a primer before placing the melt processible fluoropolymer-containing powder composition onto the article to be lined, as shown in the Examples.

EXAMPLES

The type of the fluoropolymer powder, the tubes coated, the lining process, and the test coating formation procedure used in these examples are described below.

1. Hot Meltable Fluoropolymer
   (1) Filler-free PFA "PFA9738-J" (Mitsui-DuPont Fluorochemicals KK)
   (2) Filler-loaded PFA "PFA4501-J" (Mitsui-DuPont Fluorochemicals KK), which is "PFA345-J" compounded with 25 wt % of glass fiber and 1 wt % of PPS.
2. Test Coating Formation Procedure
   The substrates were lined by the following method:
   (1) Tube to be lined: #60 alumina sand blasted 3B black iron tube (89 mm outer diameter×81 mm inner diameter×150 mm long)
   (2) Roto-molding machine: manufactured by Tabata Kikai Kogyo, "Rotolining mold machine"
   (3) Powder composition weight: 100–200 g
3. Evaluation of Lining Film
   (a) Film formation properties and surface smoothness
   The lined tube was allowed to cool to room temperature and the film formation properties and surface smoothness of the lined film were visually classified into one of 3 grades: O is the highest grade; Δ is the second grade and is less good than the highest grade; X is the lowest grade and may be said to be describe a poor coating.
   (b) Resistance to bubble formation
   The lined coating was sliced by a cutter and the number of gas bubbles was counted across a cross-section (50 mm long).
   ○: number of bubbles seen: 0
   Δ: number of bubbles seen: 1–5
   X: number of bubbles seen: 6 or more
   (c) Spherulite size
   The diameters of 200 continuous spherulites observed on the sample surface were measured with an optical microscope (at magnifications of 100× and 400×). Spherulite structure was confirmed by polarized light. Since spherulites collide with adjacent spherulites and are observed as distorted polyhedrons, their major axis length was taken to be their diameter. For samples having spherulite diameters of not more than 5 $\mu$m, a scanning electron microscope (magnifications of 3,000× and 5,000×) was used to measure the spherulite diameter.

Examples 1–4

Cylindrical 3B black tubes described were used as tube samples to be lined. They were subjected to a rotolining for 3 hours using a filler-loaded PFA (Mitsui DuPont Fluorochemicals, "PFA 4501-J", powder with an average particle size 300 $\mu$m) at a rate of revolution of 500 rpm (circumferential rate at the substrate surface 2.12 m/sec, radial acceleration of 111 m/sec$^2$) at the molding temperature shown in Table 1. The resistance to bubble formation and surface smoothness of the resultant lined tubes were evaluated. The results are summarized in Table 1.

Examples 5–7

Conditions were the same as in Examples 1–4 except that rotation was at 700 rpm (equivalent to a circumferential rate at the substrate surface of 2.97 m/sec, or a radial acceleration of 218 m/sec$^2$). The results are summarized in Table 1.

Comparative Examples 1–2

Comparative Examples 1–2 are similar to Examples 1–2 except that the rotation rate is reduced to 300 rpm (circumferential rate at the substrate surface of 1.27 m/sec, a radial acceleration of 40 m/sec$^2$). The resistance to bubble formation and surface smoothness of the lined tubes were evaluated. The results are summarized in Table 1.

Comparative Examples 3–5

Rotolining operations were carried out for 3 hours using a PFA ("PFA 4501-J" powder containing a filler with an average particle size of 50 μm at 300, 500, or 700 rpm and a molding temperature of 360° C. The resistance to bubble formation and surface smoothness of the resultant lined tubes were evaluated. The results are summarized in Table 1.

Comparative Examples 6–8

Rotolining operations were carried out for 3 hours using a PFA ("PFA 4501-J" powder containing a filler with an average particle size of 1050 μm at 300, 500, or 700 rpm and a molding temperature of 360° C. The resistance to bubble formation and surface smoothness of the resultant lined tubes were evaluated. The results are summarized in Table 1.

Examples 8–9

Rotolining operations were carried out for 3 hours using a filler-free PFA ("PFA 9738-J") powder with an average particle size of 350 μm at 500 and 700 rpm and a molding temperature of 327° C. The resistance to bubble formation and surface smoothness of the resultant lined tubes were evaluated; in addition, the average and maximum surface roughness, spherulite size, tensile strength, elongation, and specific weight were measured for the Example 8 lined tube. The results are summarized in Table 2.

Example 10

Example 10 was done in a manner similar to that of Example 9 except that the molding temperature was 360° C. The lined tubes were evaluated for resistance to bubble formation and for surface smoothness; in addition, the average and maximum surface roughness, and spherulite size were measured. The results are summarized in Table 2. Note the higher temperature of this Example leads to a greater spherulite size and surface roughness than are seen in Example 8, in which the temperature was lower.

Example 11

Example 11 was done in a manner similar to Example 10 with the addition of 0. 5 wt % (based on the weight of PFA 9738-J used) of Zonyl® TLP-10F-1 (a polytetrafluoroethylene polymer having a temperature of crystallization of at least 305° C. and heat of crystallization of at least 50 J/g; a product of Mitsui-Dupont Fluorochemicals KK, Japan). The results are summarized in Table 2. Note the beneficial effect of the added TEFLON® TLP-10F-1 on spherulite size and surface roughness.

Comparative Examples 9–11

Rotolining was carried out for 3 hours using a filler-free PFA "PFA 9738-J" having an average particle size of 350 μm at the molding temperatures shown in Table 2 at 300 rpm (circumferential rate at the substrate surface, 1.27 m/sec, radial acceleration of 40 m/sec$^2$. The resistance to bubble formation and the surface smoothness of the resultant lined tubes was evaluated and the average surface roughness, spherulite size, tensile strength, elongation, and specific weight were measured on the liner from Comparative Example 9. The results are summarized in Table 2. Note that the surface roughness and spherulite size are greater than is seen in Example 8, for which the radial acceleration was greater.

Comparative Examples 12–13

Rotolining was carried out at 500 rpm and a molding temperature of 327° C. using a filler-free PFA ("PFA 9738-J") powder having an average particle size of 50 μm or 1050 μm. The resistance to bubble formation and surface smoothness of the resultant lined tubes were evaluated. The results are summarized in Table 2.

Example 12

A filler-free PFA powder was used for lining the top surface of a filler-loaded PFA coated layer on a primer-treated tube. The steps in this example were:

(1) Primer Treatment

Primer "850–314" (DuPont Company) was coated to a thickness of 7–10 μm into the interior surface of a single tube, followed by heating for 1 hour at 400° C.

(2) Filler-Loaded PFA Lining

Rotolining was carried out at 700 rpm and a molding temperature of 360° C. for 5 hours using 200 g of filler-loaded PFA ("PFA 4501-J") of an average particle size 300 μm, after which the product was allowed to cool. The properties of the surface were measured and the results are summarized in Table 3.

(3) Filler-Free PFA Lining

Rotolining of the tube from Step (2) was carried out using 100 g of a filler-free PFA ("PFA 9738-J") powder of an average particle size 350 μm. Rotolining was done for 3 hours at 700 rpm and a molding temperature of 327° C., thereby generating a combined 3-layer lining, including the primer treated layer. The physical properties of the surface were measured and the results are summarized in Table 3.

Durability testing was done on the 3-layer lined film and the results reported below.

Test machine: Besthel ATT-2R Heat impact tester

Test condition: Expose sample to −30° C. for 2 hr, then heat to 260° C. and hold for 2 hr; repeat for a total of 30 times.

Result: lined film did not peel

TABLE 1

Lining with filler-loaded PFA powder

| Examples | Average particle size μm | Revolutions per minute rpm | Circumferential rate m/sec | Radial Acceleration m/sec$^2$ | Molding temp. ° C. | Molding time hr | Resistance to bubble formation | Surface smoothness |
|---|---|---|---|---|---|---|---|---|
| 1 | 300 | 500 | 2.12 | 111 | 327 | 3 | ○ | ○ |
| 2 | 300 | 500 | 2.12 | 111 | 360 | 3 | ○ | ○ |
| 3 | 300 | 500 | 2.12 | 111 | 380 | 3 | Δ | ○ |
| 4 | 300 | 500 | 2.12 | 111 | 400 | 3 | Δ | ○ |
| 5 | 300 | 700 | 2.97 | 218 | 327 | 3 | ○ | ○ |

TABLE 1-continued

Lining with filler-loaded PFA powder

| Examples | Average particle size μm | Revolutions per minute rpm | Circumferential rate m/sec | Radial Acceleration m/sec$^2$ | Molding temp. ° C. | Molding time hr | Resistance to bubble formation | Surface smoothness |
|---|---|---|---|---|---|---|---|---|
| 6 | 300 | 700 | 2.97 | 218 | 360 | 3 | ○ | ○ |
| 7 | 300 | 700 | 2.97 | 218 | 400 | 3 | Δ | ○ |
| Comp. 1 | 300 | 300 | 1.27 | 40 | 327 | 3 | X | X |
| Comp. 2 | 300 | 300 | 1.27 | 40 | 360 | 3 | X | X |
| Comp. 3 | 50 | 300 | 1.27 | 40 | 360 | 3 | X | X |
| Comp. 4 | 50 | 500 | 2.12 | 111 | 360 | 3 | Δ | X |
| Comp. 5 | 50 | 700 | 2.97 | 218 | 360 | 3 | Δ | X |
| Comp. 6 | 1050 | 300 | 1.27 | 40 | 360 | 3 | X | X |
| Comp. 7 | 1050 | 500 | 2.12 | 111 | 360 | 3 | Δ | X |
| Comp. 8 | 1050 | 700 | 2.97 | 218 | 360 | 3 | Δ | X |

TABLE 2

Filler-free PFA powder lining

| Example | Particle size μm | Rpm | Circumferential/ rate m/sec | Radial Acceleration m/s$^2$ | Molding temp. ° C. | Molding Time hr | Resistance to bubble formation | Surface smoothness | Surface roughness μm Ave. | Surface roughness μm Max. | Spherulite size μm | Tensile strength kg/cm$^2$ | Elongation % | Specific gravity |
|---|---|---|---|---|---|---|---|---|---|---|---|---|---|---|
| 8 | 350 | 500 | 2.12 | 111 | 327 | 3 | ○ | ○ | 0.09 | 0.58 | 1.4 | 313 | 423 | 2.166 |
| 9 | 350 | 700 | 2.97 | 218 | 327 | 3 | ○ | ○ | | | | | | |
| Comp. 9 | 350 | 300 | 1.27 | 40 | 327 | 3 | Δ | X | 0.41 | 2.5 | 7.8 | 288 | 409 | 2.162 |
| 10 | 350 | 700 | 2.97 | 218 | 360 | 3 | Δ | ○ | 0.15 | 0.82 | 31 | | | |
| 11 | 350 | 700 | 2.97 | 218 | 360 | 3 | Δ | ○ | 0.06 | 0.42 | 2.5 | | | |
| Comp. 10 | 350 | 300 | 1.27 | 40 | 330 | 3 | ○ | X | | | | | | |
| Comp. 11 | 350 | 300 | 1.27 | 40 | 360 | 3 | Δ | X | | | | | | |
| Comp. 12 | 50 | 500 | 2.12 | 111 | 327 | 3 | ○ | X | | | | | | |
| Comp. 13 | 1050 | 500 | 2.12 | 111 | 327 | 3 | ○ | X | | | | | | |

1 kg/cm$^2$ = 9.81 · 10$^4$ Pa

TABLE 3

Double layer lining

| Example | | Filler | Average particle size μm | Rpm | Circumferential rate m/sec | Radial Acceleration m/sec$^2$ | Molding Temperature ° C. | Molding time hr | Resistance to bubble formation | Surface smoothness |
|---|---|---|---|---|---|---|---|---|---|---|
| 12 | Interior layer | None | 300 | 700 | 2.97 | 218 | 360 | 5 | ○ | ○ |
| | Outer layer | Yes | 350 | 700 | 2.97 | 218 | 327 | 3 | ○ | ○ |

What is claimed is:

1. A rotolining process which comprises placing a powder having an average particle size of 70–1000 μm containing a melt processible fluoropolymer and filler, in a cylindrical article having a surface to be lined, said powder being present in sufficient amount to make a lining at least 500 μm thick, rotating said cylindrical article to bring the radial acceleration at said surface to be lined to 100 m/sec$^2$ or greater, pressing said powder against the surface to be lined by means of the centrifugal force generated by said rotating, heating the melt processible fluropolymer during said rotating to a temperature equal to or higher than its melting point, but not higher than 400° C., thereby adhering the melt processible fluoropolymer to said surface to be lined.

2. The rotolining process of claim 1 wherein the melt processible fluoropolymer is a tetrafluoroethylene/perfluoro (alkyl vinyl ether) copolymer.

3. The rotolining process of claim 1 wherein the melt processible fluoropolymer is a tetrafluoroethylene/perfluoro (alkyl vinyl ether) resin powder composition obtained by blending in a polytetrafluoroethylene polymer having a temperature of crystallization of at least 305° C. and heat of crystallization of at least 50 J/g in an amount of less than 4% by weight with respect to the total fluoropolymer.

4. The rotolining process of claim 1 wherein the temperature is not higher than 343° C.

5. The rotolining process of claim 1 wherein the radial acceleration is 200 m/sec$^2$.

6. The rotolining process of claim 1 or claim 2 further comprising forming said lining of said powder on said surface to be lined, and then overlaying a filler-free melt processible fluoropolymer lined layer as the outermost layer on top of the surface of said lining.

7. The rotolining process of claim 6 wherein a primer is first applied to the surface to be lined.

8. The rotolining process of claim 6 wherein the lining of the outermost layer is carried out at a temperature equal to or higher than the melting point of the melt processible fluoropolymer, but not higher than 343° C.

9. The rotolining process of claim 6, further comprising generating the outermost layer from a tetrafluoroethylene/perfluoro(alkyl vinyl ether) resin powder composition obtained by blending in a polytetrafluoroethylene polymer having a temperature of crystallization of at least 305° C. and heat of crystallization of at least 50 J/g in an amount of less than 4% by weight with respect to the total fluoropolymer, in such an amount that the surface of said outermost layer has a recrystallized average spherulite diameter of not more than 15 $\mu$m.

* * * * *